US005505462A

United States Patent [19]

Loewen

[11] Patent Number: 5,505,462

[45] Date of Patent: Apr. 9, 1996

[54] CONICAL DROP TOY COORDINATION GAME

[76] Inventor: Gregory M. Loewen, 2921 Tulip St., Philadelphia, Pa. 19134

[21] Appl. No.: 371,763

[22] Filed: Jan. 12, 1995

[51] Int. Cl.[6] ..... A63F 9/04

[52] U.S. Cl. ..... 273/440; 273/146

[58] Field of Search ..... 273/440, 146, 273/290, 425, 428; 446/117; 434/204, 205, 403; 73/426–427

[56] References Cited

U.S. PATENT DOCUMENTS

| | | | |
|---|---|---|---|
| D. 211,590 | 7/1968 | Watson | 273/290 X |
| 261,912 | 8/1882 | Crandall | 434/403 |
| 449,147 | 3/1891 | Welch | 73/427 |
| 783,688 | 2/1905 | Dujat | 73/427 X |
| 1,399,394 | 12/1921 | Mond | 73/427 |
| 2,110,928 | 3/1938 | De Buys | 73/428 X |
| 3,558,133 | 1/1971 | Reiner et al. | 273/449 X |
| 4,793,619 | 12/1988 | Unander-Scharin | 273/146 X |

FOREIGN PATENT DOCUMENTS

| | | | |
|---|---|---|---|
| 386380 | 1/1933 | United Kingdom | 73/426 |

*Primary Examiner*—Paul E. Shapiro

[57] ABSTRACT

A game for practicing and refining physical coordination of an individual. The inventive device includes a truncated conical body having a first end of a first diameter tapering to a second end of a larger second diameter. Numerical indica is printed proximal to each end and points are awarded to a player for spinning the conical body in the air and causing the body to land onto a support surface with one of the two ends of the body resting on the support surface.

3 Claims, 3 Drawing Sheets

CONICAL DROP TOY COORDINATION GAME

BACKGROUND OF THE INVENTION

1. Field of the Invention

The present invention relates to physical coordination toys and more particularly pertains to a conical drop toy coordination game for practicing and refining physical coordination of an individual.

2. Description of the Prior Art

The use of physical coordination toys is known in the prior art. More specifically, physical coordination toys heretofore devised and utilized are known to consist basically of familiar, expected and obvious structural configurations, notwithstanding the myriad of designs encompassed by the crowded prior art which have been developed for the fulfillment of countless objectives and requirements.

Known prior art physical coordination toys include U.S. Pat. No. 5,286,034; U.S. Pat. No. 5,261,666; U.S. Pat. No. 5,247,724; U.S. Pat. No. 5,125,512; and U.S. Pat. No. 5,203,562.

While these devices fulfill their respective, particular objectives and requirements, the aforementioned patents do not disclose a conical drop toy coordination game for practicing and refining physical coordination of an individual which includes a truncated conical body having a first end of a first diameter tapering to a second end of a larger second diameter, and numerical indica printed proximal to each end thereof, wherein points are awarded to a player for spinning the conical body in the air and causing the body to land onto a support surface with one of the two ends of the body resting on the support surface.

In these respects, the conical drop toy coordination game according to the present invention substantially departs from the conventional concepts and designs of the prior art, and in so doing provides an apparatus primarily developed for the purpose of practicing and refining physical coordination of an individual.

SUMMARY OF THE INVENTION

In view of the foregoing disadvantages inherent in the known types of physical coordination toys now present in the prior art, the present invention provides a new conical drop toy coordination game construction wherein the same can be utilized for practicing and refining physical coordination of an individual. As such, the general purpose of the present invention, which will be described subsequently in greater detail, is to provide a new conical drop toy coordination game apparatus and method which has many of the advantages of the physical coordination toys mentioned heretofore and many novel features that result in a conical drop toy coordination game which is not anticipated, rendered obvious, suggested, or even implied by any of the prior art physical coordination toys, either alone or in any combination thereof.

To attain this, the present invention generally comprises game for practicing and refining physical coordination of an individual. The inventive device includes a truncated conical body having a first end of a first diameter tapering to a second end of a larger second diameter. Numerical indica is printed proximal to each end and points are awarded to a player for spinning the conical body in the air and causing the body to land onto a support surface with one of the tow ends of the body resting on the support surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new conical drop toy coordination game apparatus and method which has many of the advantages of the physical coordination toys mentioned heretofore and many novel features that result in a conical drop toy coordination game which is not anticipated, rendered obvious, suggested, or even implied by any of the prior art physical coordination toys, either alone or in any combination thereof.

It is another object of the present invention to provide a new conical drop toy coordination game which may be easily and efficiently manufactured and marketed.

It is a further object of the present invention to provide a new conical drop toy coordination game which is of a durable and reliable construction.

An even further object of the present invention is to provide a new conical drop toy coordination game which is susceptible of a low cost of manufacture with regard to both materials and labor, and which accordingly is then susceptible of low prices of sale to the consuming public, thereby making such conical drop toy coordination games economically available to the buying public.

Still yet another object of the present invention is to provide a new conical drop toy coordination game which provides in the apparatuses and methods of the prior art some of the advantages thereof, while simultaneously overcoming some of the disadvantages normally associated therewith.

Still another object of the present invention is to provide a new conical drop toy coordination game for practicing and refining physical coordination of an individual.

Yet another object of the present invention is to provide a new conical drop toy coordination game which includes a truncated conical body having a first end of a first diameter tapering to a second end of a larger second diameter, and numerical indica printed proximal to each end thereof, wherein points are awarded to a player for spinning the conical body in the air and causing the body to land onto a support surface with one of the two ends of the body resting on the support surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
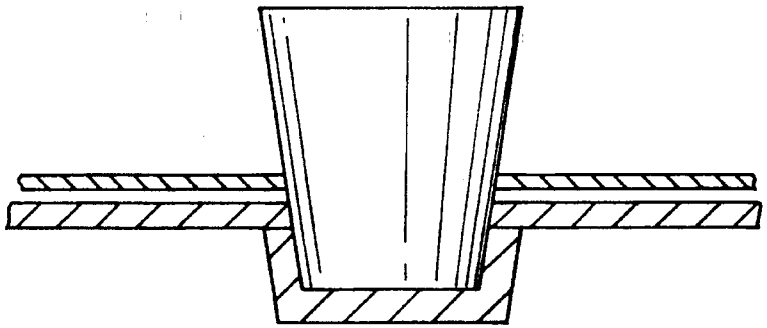
PRIOR ART FIG. 2
FIG. 2 is a cross sectional illustration of a further prior art toy.

With reference now to the drawings, and in particular to FIGS. 3–6 thereof, a new conical drop toy coordination game embodying the principles and concepts of the present invention and generally designated by the reference numeral 10 will be described.

Figure 1:
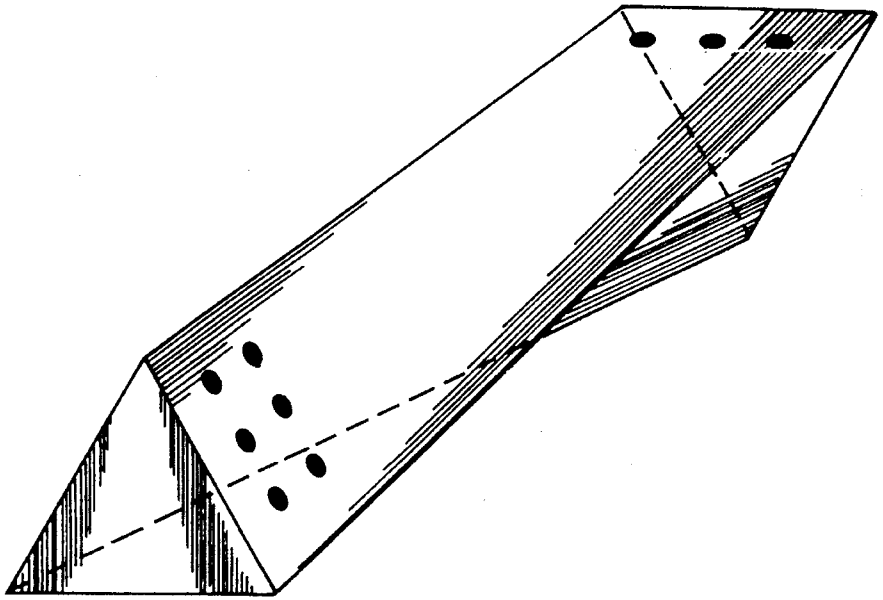
PRIOR ART FIG. 1
FIG. 1 is an isometric illustration of a prior art physical coordination toy.

Turning initially to FIGS. 1 and 2 wherein prior art physical coordination toys are illustrated, it can be shown that the prior art teaches either an elongated polygonal member, such as is illustrated in FIG. 1, or a cup member having a circular planar member projecting outwardly therefrom, as shown in FIG. 2.

Figure 3:
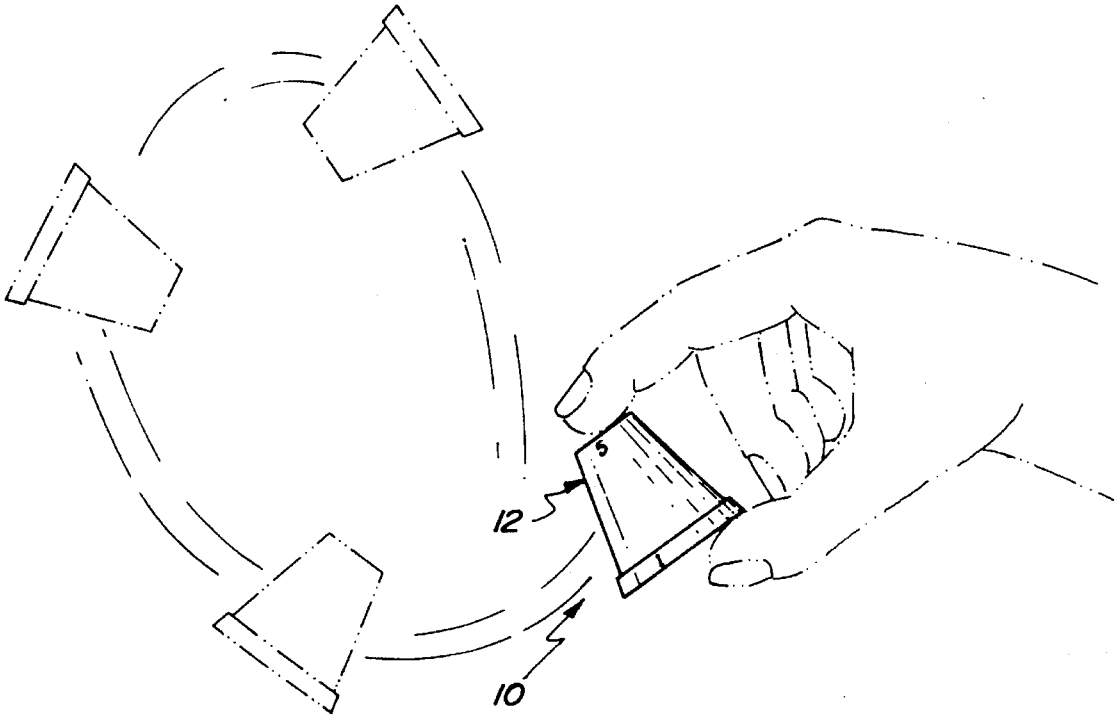
FIG. 3 is a front elevation view of a conical drop toy coordination game according to the invention in use.
Figure 4:
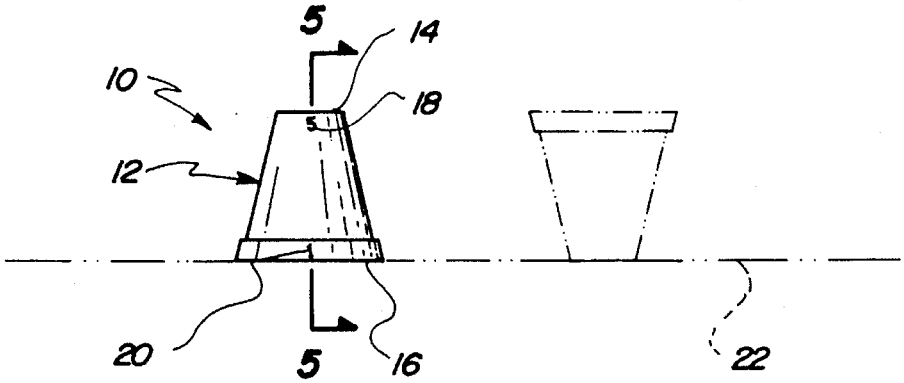
FIG. 4 is a front elevation view of a truncated conical body comprising a portion of the present invention.

Turning now to FIGS. 3 through 6 wherein the conical drop toy coordination game 10 of the present invention is illustrated in detail, it can be shown that the present invention comprises a truncated conical body 12 having a first end 14 of a first diameter and tapering into a second end 16 of a second diameter, wherein the second diameter is substantially greater than the first diameter so as to define the substantially conical shape of the truncated conical body 12. First numerical indica 18 is printed on an exterior of the truncated conical body 12 proximal to the first end 14 thereof. Similarly, second numerical indica 20 is printed on the exterior truncated conical body 12 proximal to the second end 16 thereof. By this structure, and individual can toss the truncated conical body 12, as shown in FIG. 3 to cause the body to rotate at least once in mid-air. The truncated conical body 12 will gravitationally fall onto a support surface 22 as shown in FIG. 4.

The conical body 12 of the invention 10 can be tossed as shown in FIG. 3. Preferably, the tossing of the conical body 12 comprises the positioning of a finger of a human hand against the open or closed first end 14 of the conical body and positioning a thumb of the human hand against an outer peripheral edge of the open second end 16 of the conical body so as to capture the conical body between the finger and the thumb. The human hand can then be moved to cause corresponding movement of the conical body, with a releasing of the conical body from the human hand permitting the conical body to rotate within and fall through surrounding air to a support surface 22 therebeneath.

The object of the game method of the invention 10 is to cause the truncated conical body 12 to land on either of the ends 14 or 16 thereof. Thus, a player causing the truncated conical body 12 to land on the first end 14 will be awarded a number of points according to the first numerical indica 18 printed proximal thereto. Similarly, a player causing the truncated conical body 12 to land on the second end 16 thereof will be awarded a number of points corresponding to the second numerical indica printed proximate thereto. Should the truncated conical body 12 land such that neither of the ends 14 or 16 is positioned into abutting engagement with the support surface 22, no points will be awarded to the player causing such motion. In other words, should the truncated conical body 12 land on a side thereof, the player will be awarded a total of zero points for such toss. Preferably, the first numerical indica 18 is of a value substantially greater than the second numerical indica 20 inasmuch as causing the truncated conical body 12 to land on the first end 14 of smaller diameter than the second end 16 is substantially more difficult.

Figure 5:
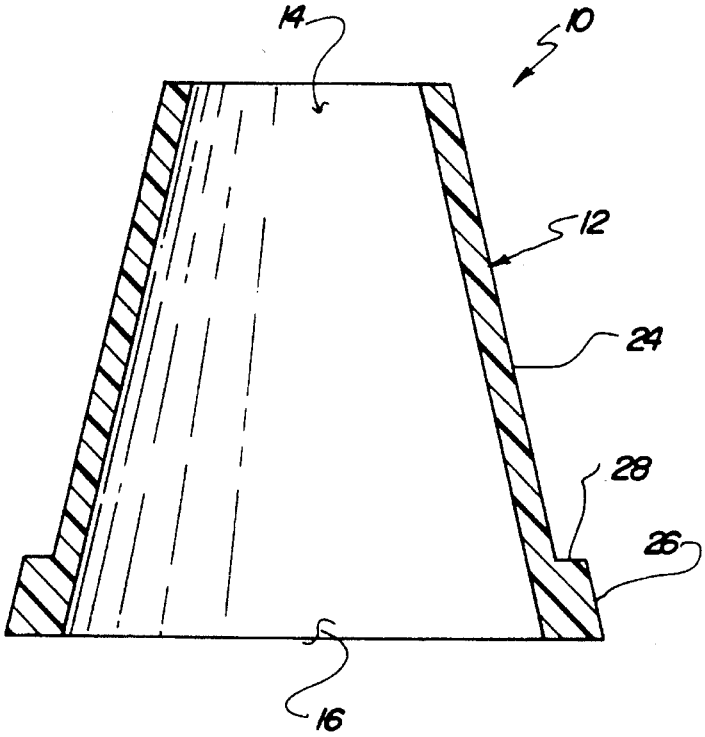
FIG. 5 is a cross sectional view taken along line 5—5 of FIG. 4.
Figure 6:
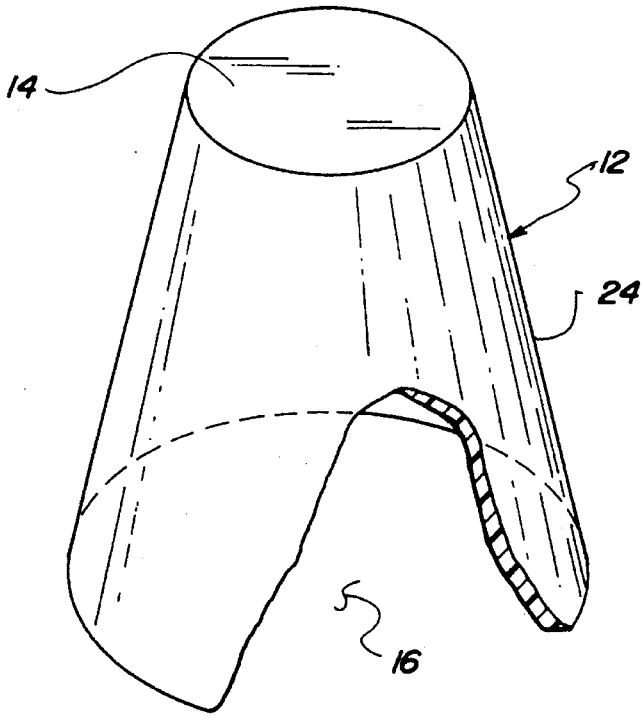
FIG. 6 is an isometric illustration, partially in cross section, of an alternative form of the truncated conical body.

Turning now to FIGS. 5 and 6, it can be shown that the truncated conical body 12 comprises a conical side wall 24 having an open first end 14 and an open second end 16. A reinforcing peripheral flange 26 can extend about the second end 16 of the conical side wall 24 to provide for reinforcing of the conical side wall 24. Further, the reinforcing peripheral flange 26 defines a projecting ridge 28 which can be engaged by digits of the human hand during tossing of the device 10.

Referring now to FIG. 6, it can be shown that the truncated conical body 12 may alternatively comprise the conical side wall 24 having a closed first end 14 and an open second end 16. By this structure, the alternative form of the truncated conical body 12 exhibits aerodynamic characteristics differing from that of the truncated conical body 12 illustrated in FIG. 5. In other words, the truncated conical body 12 including the open first end 14 permits air currents to be accelerated through the conical body to impart an aerodynamic stability to the device 10. In contrast, the truncated conical body 12 including the closed first end 14 does not permit aerodynamic currents to travel through the conical body and thus exhibits less aerodynamic stability.

In use, the conical drop toy coordination game 10 according to the present invention can be utilized by an individual to effect practicing and refining of physical coordination. The device is particularly useful with infants and children so as train the same in coordination skills at an early age.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A method of playing a coordination game comprising the steps of:

(a) providing a conical drop toy comprising a truncated conical body having a first end of a first diameter and tapering to a second end of a second diameter, wherein the second diameter is substantially greater than the first diameter so as to define a substantially conical shape of the truncated conical body; first numerical indicia printed on an exterior of the truncated conical body proximal to the first end thereof; and second numerical indicia printed on the exterior of the truncated conical body proximal to the second end thereof;

(b) tossing the truncated conical body to cause the body to rotate at least once in mid-air, the tossing of the conical body comprising positioning a finger of a human hand against the first end of the conical body and positioning a thumb of the human hand against the second end of the conical body so as to capture the conical body between the finger and the thumb; moving the human hand to cause movement of the conical body; and releasing the conical body from the human hand to permit the conical body to rotate and fall;

(c) awarding a number of points to a player according to the numerical indicia printed on the truncated conical body.

2. The method of playing a coordination game of claim 1, wherein the step (c) comprises awarding the player a first number of points corresponding to the first numerical indica should the truncated conical body land on the first end; awarding the player a second number of points corresponding to the second numerical indica should the truncated conical body land on the second end; awarding the player no points should the truncated conical body land on a side thereof.

3. A method of playing a coordination game comprising the steps of:

(a) providing the a conical drop toy comprising a truncated conical body having a first end of a first diameter and tapering to a second end of a second diameter, wherein the second diameter is substantially greater than the first diameter so as to define a substantially conical shape of the truncated conical body, the conical body comprising a conical side wall having a closed first end and an open second end; first numerical indicia printed on an exterior of the truncated conical body proximal to the first end thereof; and second numerical indicia printed on the exterior of the truncated conical body proximal to the second end thereof;

(b) tossing the truncated conical body to cause the body to rotate at least once in mid-air, the tossing of the conical body comprising positioning a finger of a human hand against the closed first end of the conical body and positioning a thumb of the human hand against an outer peripheral edge of the open second end of the conical body so as to capture the conical body between the finger and the thumb; moving the human hand to cause movement of the conical body; and releasing the conical body from the human hand to permit the conical body to rotate within and fall through surrounding air;

(c) awarding a number of points to a player according to the numerical indicia printed on the truncated conical body.

* * * * *